US010690403B2

(12) United States Patent
Gossens et al.

(10) Patent No.: US 10,690,403 B2
(45) Date of Patent: Jun. 23, 2020

(54) ENCLOSURE ILLUMINATION

(71) Applicant: Electrolux Home Products, Inc., Charlotte, NC (US)

(72) Inventors: Caleb Gossens, Anderson, SC (US); Thomas Doyle, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 88 days.

(21) Appl. No.: 15/753,404

(22) PCT Filed: Aug. 21, 2015

(86) PCT No.: PCT/US2015/046236
§ 371 (c)(1),
(2) Date: Feb. 19, 2018

(87) PCT Pub. No.: WO2017/034514
PCT Pub. Date: Mar. 2, 2017

(65) Prior Publication Data

US 2018/0238612 A1 Aug. 23, 2018

(51) Int. Cl.
*F21V 23/00* (2015.01)
*F25D 27/00* (2006.01)
(Continued)

(52) U.S. Cl.
CPC ..... *F25D 27/00* (2013.01); *F21V 23/001* (2013.01); *F25D 23/026* (2013.01);
(Continued)

(58) Field of Classification Search
CPC .... F25D 27/00; F25D 23/026; F25D 2400/10; F25D 2400/40; F21V 23/001;
(Continued)

(56) References Cited

U.S. PATENT DOCUMENTS 3,938,132 A * 2/1976 Cunningham ..... A01K 97/06 340/321
4,754,376 A 6/1988 Winslow
(Continued)

FOREIGN PATENT DOCUMENTS

DE 102010031039 1/2012
EP 1780486 5/2007

OTHER PUBLICATIONS

International Search Report for PCT/US2015/046236, dated Apr. 22, 2016, 3 pages.

*Primary Examiner* — Bao Q Truong
(74) *Attorney, Agent, or Firm* — Pearne & Gordon LLP

(57) ABSTRACT

An assembly comprises an enclosure (10) including an enclosure interior (12) configured to retain articles therein. An electrically conductive means (30) can electrically connect the enclosure (10) to a source of electrical power (31) for providing electrical energy to the enclosure (10) for application to an operation that relies on electric energy for its performance and takes place at the enclosure interior (12). The assembly includes a light source (16), the position of which is adjustable so as to illuminate any selected one of a plurality of locations within the enclosure interior (12). An electrically conductive line (17) is electrically configured to be connected at the enclosure (10) to the source of electrical power (31) and connected to the light source (16) for providing electrical energy to the light source (16).

19 Claims, 3 Drawing Sheets

(51) Int. Cl.

| | |
|---|---|
| ***F25D 23/02*** | (2006.01) |
| *F21W 131/305* | (2006.01) |
| *F21V 33/00* | (2006.01) |

(52) U.S. Cl.
CPC .... *F21V 33/0044* (2013.01); *F21W 2131/305* (2013.01); *F25D 2400/10* (2013.01); *F25D 2400/40* (2013.01)

(58) Field of Classification Search
CPC ..... F21V 33/0044; F21V 21/14; F21V 21/16; F21V 15/01; F21V 17/10; F21V 17/105; F21V 17/00; F21V 19/00; F21V 19/02; F21V 21/08; F21V 21/0906; F21V 21/0965; F21W 2131/305
See application file for complete search history.

(56) References Cited

U.S. PATENT DOCUMENTS

| | | | | | |
|---|---|---|---|---|---|
| 5,459,648 | A * | 10/1995 | Courtney | A45C 15/06 | 206/373 |
| 5,580,155 | A | 12/1996 | Hildebrand et al. | | |
| 5,611,170 | A * | 3/1997 | McGuff | A01K 97/06 | 43/54.1 |
| 5,873,646 | A * | 2/1999 | Fjaestad | F21V 7/005 | 362/92 |
| 6,254,251 | B1 * | 7/2001 | Washington | A45C 15/06 | 362/154 |
| 6,267,484 | B1 * | 7/2001 | Baker | A01K 97/06 | 362/154 |
| 7,033,040 | B2 | 4/2006 | Spahr et al. | | |
| 7,264,371 | B1 * | 9/2007 | Seagriff | A45C 15/06 | 190/106 |
| 8,132,937 | B2 | 3/2012 | Kountotsis | | |
| 2012/0274189 | A1 | 11/2012 | Alley et al. | | |
| 2013/0033854 | A1 | 2/2013 | Statham | | |

* cited by examiner

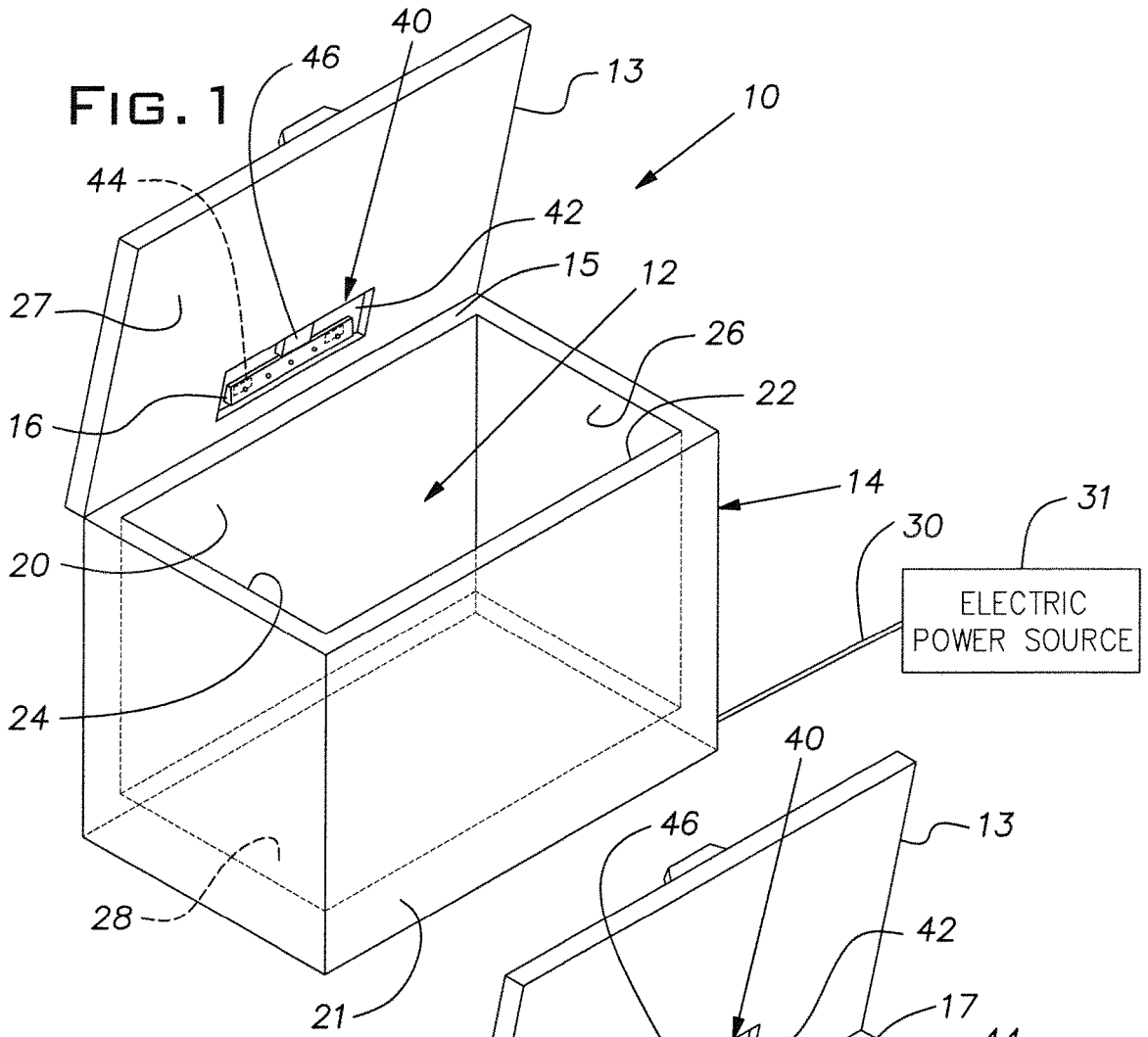
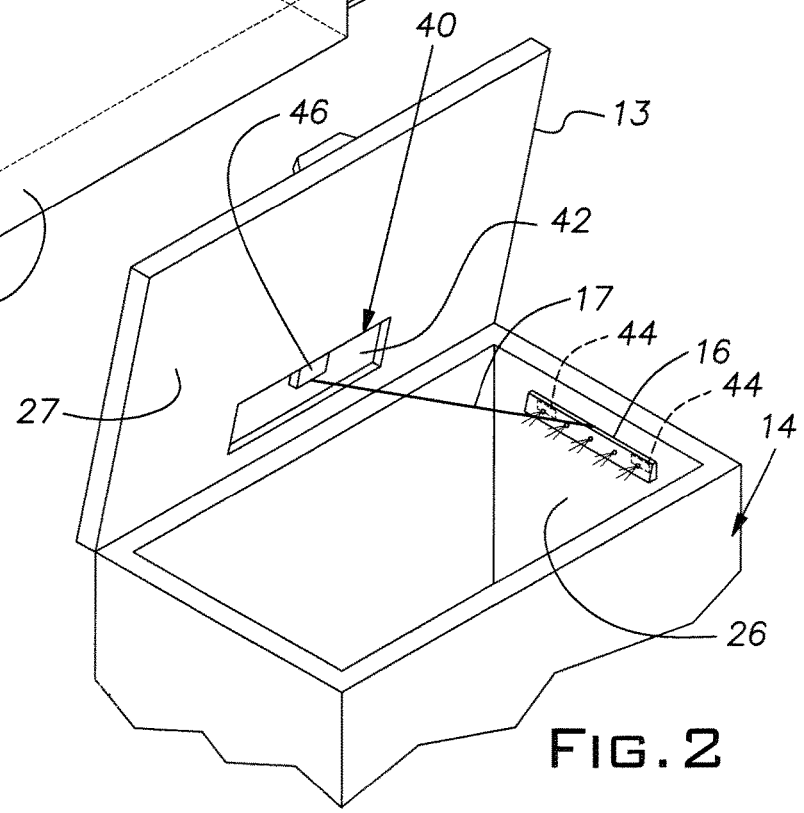
FIG. 2

FIG. 3
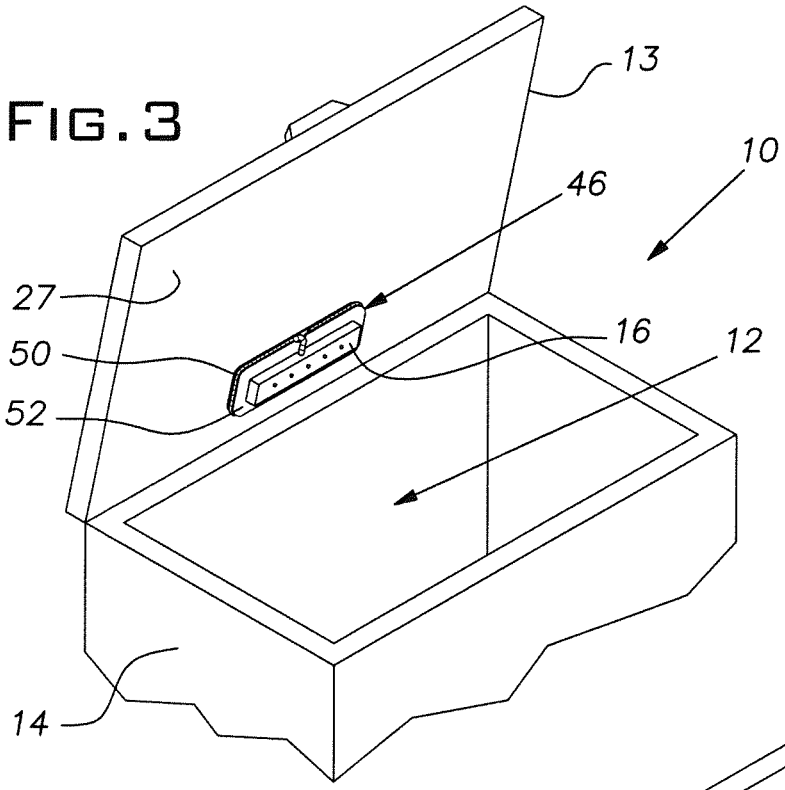
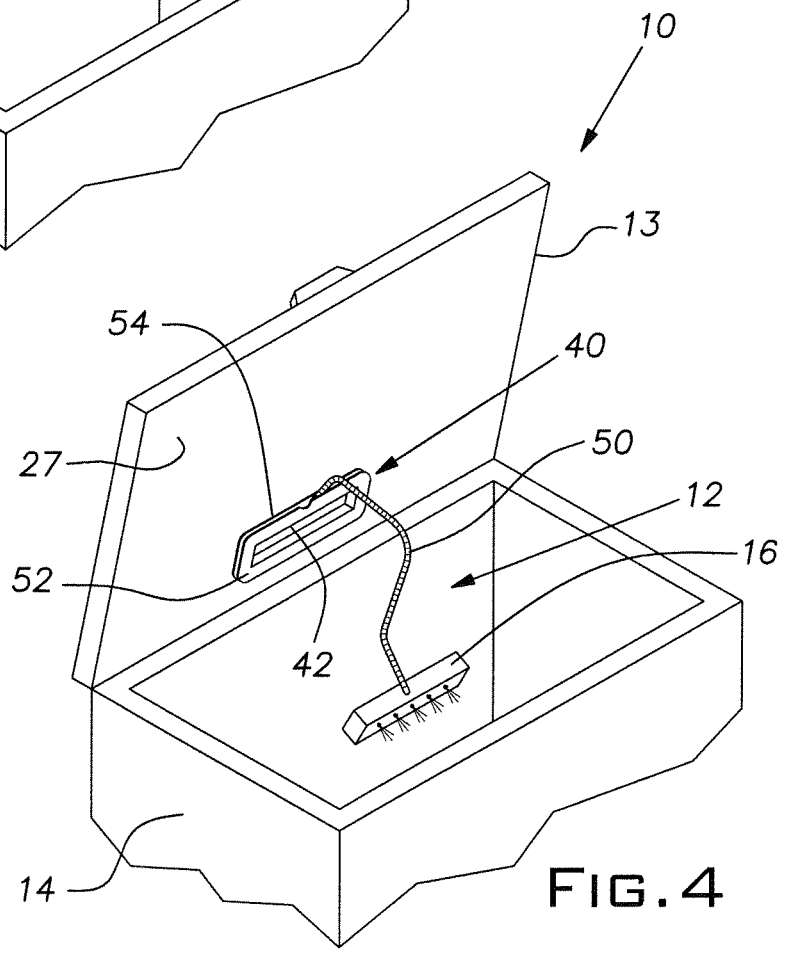
FIG. 4

ENCLOSURE ILLUMINATION

FIELD OF THE INVENTION

The present invention relates, in general, to the illumination of the interiors of enclosures and, in particular, to light sources that can be selectively positioned within storage enclosures interiors, such as freezer chest interiors for example, for the purpose of illuminating any selected one of a plurality of locations within the storage enclosure interiors.

BACKGROUND OF THE INVENTION

Typically, storage enclosures, when provided with light sources for the purpose of illuminating the interiors of the storage enclosures, have the light sources fixed in place with the expectation that the fixed light sources will serve to adequately illuminate all areas of the storage enclosure interiors. However, often, perhaps because of the configuration or expanse of the storage enclosure interiors or because of interference caused by objects present in the storage enclosure interiors, the light sources will fail to illuminate all areas of the storage enclosure interiors to the degree that is desired. Consequently, a need exists for light sources for storage enclosures, such as freezer chests for example, that can be located within the interiors of the storage enclosures and conveniently, variously positioned so as to illuminate any selected one of a plurality of locations or areas within the storage enclosure interiors.

BRIEF SUMMARY OF THE INVENTION

The following presents a simplified summary of the invention in order to provide a basic understanding of selected aspects of the invention. The summary does not comprise an extensive overview of the invention nor is the summary intended to identify key or critical elements of the invention or to delineate the scope of the invention. The sole purpose of the summary is to present selected concepts of the invention in a simplified form as a prelude to the more detailed description that is presented later herein.

According to one aspect of the present invention, an assembly comprises an enclosure that includes an enclosure interior that can be configured to retain articles therein. The assembly also can comprise an electrically conductive means by which the enclosure can be electrically connected to a source of electrical power for providing electrical energy to the enclosure for application to an operation that relies on electric energy for its performance and that can take place at the enclosure interior. The assembly can further comprise a light source, the position of which can be adjustable so as to illuminate any selected one of a plurality of locations within the enclosure interior. The assembly also can comprise an electrically conductive line that can be configured to be connected at the enclosure to the source of electrical power and connected to the light source for providing electrical energy to the light source. With respect to this aspect and all the other aspects of the present invention referred to below, the enclosure can comprise a refrigeration appliance which can comprise a freezer chest. In those instances, the enclosure interior can comprise a refrigeration appliance interior and a freezer chest interior, respectively, and the operation that can take place at the enclosure interior can take place at the freezer chest interior and can comprise the maintenance of perishable articles at the freezer chest interior at temperatures at and below 32 degrees Fahrenheit.

According to another aspect, the enclosure interior can be delimited by one or more enclosure interior surfaces, and the light source can be removably located at one of the one or more enclosure interior surfaces at a base station for the light source. The light source can include an attachment feature by means of which the light source can be both removably attachable at the one of the one or more enclosure interior surfaces at the base station and removably attachable at the one or more enclosure interior surfaces away from the base station at a position enabling the light source to illuminate any selected one of the plurality of locations within the enclosure interior. Relatedly, the electrically conductive line can be of a length sufficient to permit the light source to be removably attachable at the one of the one or more enclosure interior surfaces away from the base station at positions enabling the light source to illuminate any selected one of the plurality of locations within the enclosure interior.

According to a further aspect, the enclosure with respect to the foregoing and following aspects can include a hinged lid that can include a lid interior surface that can comprise one of the enclosure interior surfaces. The hinged lid can allow for access to be had to the enclosure interior upon raising of the hinged lid from a position closing off the enclosure interior; and the base station can comprise a recess at the lid interior surface within which the light source can be removably maintained.

According to an additional aspect, the attachment feature with respect to all the foregoing aspects and the Wowing aspects that include an attachment feature can comprise a magnetic material, such as a permanent magnet for example, and each position enabling the light source to illuminate any selected one of the plurality of locations within the enclosure interior and the recess can include a material that is magnetically attractive material, whereby the light source can be attached at a selected one of each position by means of the magnetic material.

According to yet another aspect, the assembly with respect to all the foregoing aspects can include an electric cord reel that retains the electrically conductive line.

According to yet a further aspect, the electrically conductive line alternatively can be encased within a flexible self-supporting electrical conduit and the enclosure, such as the freezer chest for example, can include a base station at which the light source and the flexible self-supporting electrical conduit can be maintained. The electrically conductive line and the flexible self-supporting electrical conduit can be of a length sufficient to permit the position of the light source to be adjusted so as to illuminate any selected one of the plurality of locations within the enclosure interior.

According to still another aspect, the enclosure can include a hinged lid and a storage compartment within which the enclosure interior can be located. The hinged lid can be supported for pivotal movement at an upper edge of the storage compartment and allow for access to be had to the enclosure interior upon raising of the hinged lid from the upper edge of the storage compartment. The light source can include an attachment feature by means of which the light source is removably attachable at positions enabling the light source to illuminate any selected one of the plurality of locations within the enclosure interior. The electrically conductive line, which can be of a length sufficient to enable the light source to illuminate any selected one of the plurality of locations within the enclosure interior, can be releasably stored at the upper edge of the storage compartment.

BRIEF DESCRIPTION OF THE DRAWINGS

The foregoing and other features and advantages of the present invention will become apparent to those skilled in the art to which the present invention relates upon reading the description below with reference to the accompanying drawings, in which:

FIG. 1 is a somewhat schematic perspective view of an example of a first embodiment of the invention, wherein a first example of a light source is illustrated as being located in a stored position in an enclosure comprising a freezer chest;

FIG. 2 is a somewhat schematic partial perspective view of the example of the first embodiment of the invention shown in FIG. 1, wherein the first example of the light source is illustrated as removed from the stored position to a selected one of a plurality of positions at which the light source can be placed away from the stored position in the enclosure;

FIG. 3 is a somewhat schematic partial perspective view of an example of a second embodiment of the invention, wherein a second example of a light source is illustrated as being located in a stored position in an enclosure comprising a freezer chest;

FIG. 4 is a somewhat schematic partial perspective view of the example of the second embodiment of the invention shown in FIG. 3, wherein the second example of the light source is illustrated as removed from the stored position to a selected one of a plurality of positions at which the light source can be positioned away from the stored position in the enclosure.

DESCRIPTION OF EXAMPLE EMBODIMENTS

Figure 5:
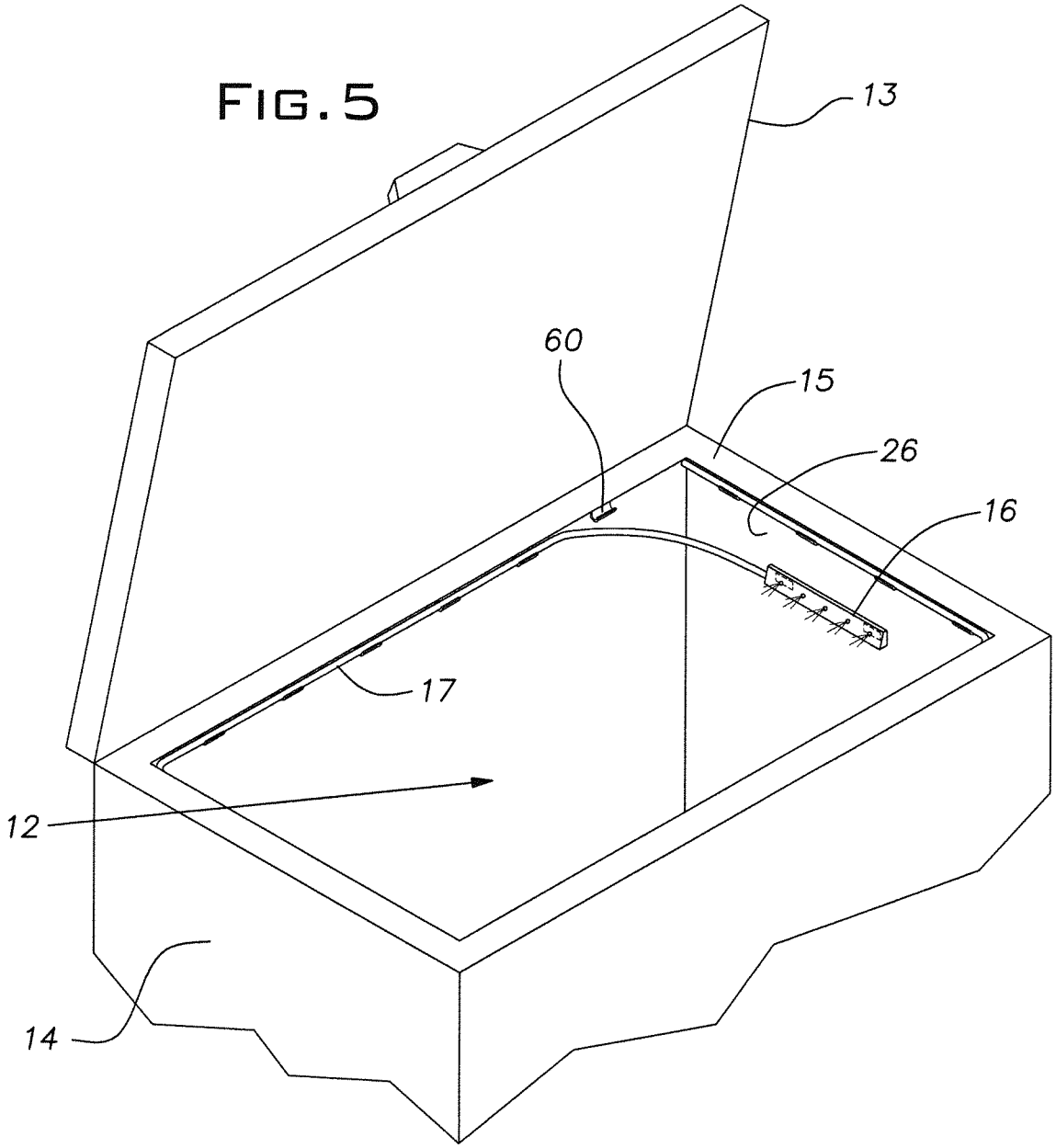
FIG. 5 is a somewhat schematic partial perspective view of an example of a third embodiment of the invention, wherein an example of a light source is illustrated as being located in a selected position in an enclosure comprising a freezer chest for the purpose of illuminating the area of the enclosure adjacent the selected position.

The present invention will now be described with reference to the drawings, wherein like reference numerals are used to refer to like elements throughout. It is to be appreciated that the various drawings are not necessarily drawn to scale from one figure to another or within a given figure. Also, the sizes of the components are somewhat arbitrarily drawn in order to facilitate an understanding of the drawings. In the following description, numerous specific details are set forth in order to provide a thorough understanding of the present invention, but it can be possible in certain instances to practice the present invention without those specific details.

The present invention comprises an assembly including an enclosure that includes an enclosure interior configured to retain articles therein. In FIG. 1, the enclosure constitutes a refrigeration appliance that comprises a freezer chest, indicated generally at 10, and the enclosure interior comprises a freezer chest interior, indicated generally at 12, configured to retain perishable articles therein. The enclosure interior is delimited by one or more enclosure interior surfaces. In the example of the first embodiment of the invention shown in FIG. 1, the enclosure interior surfaces include a rear wall interior surface 20 of the freezer chest 10, a front wall interior surface 22 of the freezer chest 10, a first side wall interior surface 24 of the freezer chest 10, a second side wall interior surface 26 of the freezer chest 10 and a bottom wall interior surface 28 of the freezer chest 10.

Also in the example of the first embodiment of the invention shown in FIG. 1, the enclosure comprising the freezer chest 10 includes a hinged lid 13 that includes a lid interior surface 27 that comprises one of the enclosure interior surfaces. The hinged lid allows for access to be had to the enclosure interior, comprising the freezer chest interior 12, upon raising or lifting of the hinged lid from a position closing off the freezer chest interior 12. More specifically, the freezer chest 10 includes, in addition to the hinged lid 13, a storage compartment, indicated generally at 14, within which the enclosure interior comprising the freezer chest interior 12 is located. The hinged lid 13 is supported for pivotal movement at an upper edge 15 of the storage compartment 14 that extends around a perimeter of an open top of the storage compartment 14 allowing for access to be had to the enclosure interior comprising the freezer chest interior 12 upon raising or lifting of the hinged lid 13 from the upper edge 15 of the storage compartment 14.

The assembly of the invention also includes an electrically conductive means by which the enclosure can be electrically connected to a source of electrical power for providing electrical energy to the enclosure for application to an operation that relies on electric energy for its performance and takes place at the enclosure interior. Thus, in FIG. 1, the assembly of the invention includes an electrical power cord or cable 30 by which the freezer chest 10 is electrically connected to a source of electrical power 31, such as an AC power supply or batteries for example, for providing electrical energy to the freezer chest 10. As will be understood by those skilled in the art, the power cord or cable 30 can comprise a 3-prong or 4-prong power cord, for example, that can be plugged into an electrical wall socket to which the source of electric power 31 is electrically connected. Alternately, the power cord can be wired directly to the source of electric power 31 and the use of a plug-in connection avoided.

In the case of the example of the first embodiment of the invention shown in FIG. 1, the electrical energy that is provided to the freezer chest 10 is provided for an operation that takes place at the freezer chest interior 12 and comprises the maintenance of perishable articles at the freezer chest interior 12 at temperatures at and below 32 degrees Fahrenheit. The equipment for providing the necessary cooling effect at the freezer chest interior 12 such as for example a compressor, a condenser and an evaporator, can be housed at the bottom 21 and internally of the freezer chest 10 below the bottom wall interior surface 28 of the freezer chest 10. Although the temperature maintained at the freezer chest interior 12 can be as high as 32 degrees Fahrenheit, the quality of the perishable articles will be maintained longer if the temperature at the freezer chest interior 12 is maintained in the range of minus 10 to minus 20 degrees Fahrenheit.

Also included in the assembly of the invention is a light source 16 the position of which is adjustable, as described in greater detail below, so as to illuminate any selected one of a plurality of locations within the enclosure interior, comprising the freezer chest interior 12. The assembly additionally includes an electrically conductive line, not shown in FIG. 1 but shown at 17 in FIG. 2, which is electrically configured to be connected at the enclosure comprising the freezer chest 10 to the source of electrical power 31 and is connected to the light source 16 for providing electrical energy to the light source 16. Stated otherwise, the light source 16 can be connected to an electrical wiring system at the freezer chest 10 that is connected to the source of electrical power 31 and functions to provide electrical energy to the various components that reside at the freezer chest 10 and rely on electrical energy for their performance.

The light source of the assembly of the invention is removably located at one of the one or more enclosure interior surfaces at a base station for the light source. In the example of the first embodiment of the invention shown in FIG. 1, the light source 16 is removably located at a base station 40 that includes a recess 42 at the lid interior surface 27 within which the light source 16 can be removably maintained.

The light source 16 includes an attachment feature by means of which the light source is both removably attachable at the one or more enclosure interior surfaces, such as the lid interior surface 27, at the base station 40 and removably attachable at the one or more enclosure interior surfaces comprising the freezer chest interior surfaces away from the base station 40, thereby enabling the light source 16 to illuminate any selected one of the plurality of locations within the enclosure interior comprising the freezer chest interior 12. Thus, in the example shown in FIG. 1, the light source 16 is shown to be removably attachable at the base station 40 at the lid interior surface 27 and in FIG. 2 the light source is shown to be removed from the base station 40 and removably attached at the second side wall interior surface 26 of the freezer chest interior 12 so as to preferentially illuminate the freezer chest interior at the vicinity of second side wall interior surface 26.

In the example of the first embodiment of the invention shown in FIGS. 1 and 2, the attachment feature at the light source 16 comprises a magnetic material such as one or more permanent magnets 44 for example. Correlatively, each position that enables the light source 16 to illuminate any selected one of the plurality of locations within the enclosure interior comprising the freezer chest interior 12 and the recess 42 include a material that is magnetically attractive, whereby the light source 16 can be attached at a selected one of each position and the recess 42 by means of the magnetic material. That is to say that if the wall interior surfaces of the freezer chest interior 12 are constructed of magnetically attractive steel, the light source 16 can be attached directly to those wall interior surfaces at any location. However, if the wall interior surfaces are constructed of a material that is not magnetically attractive, such as a plastic for example, magnetically attractive steel tabs of a size consistent with the size of the light source 16 can be located at a plurality of advantageous locations at the wall interior surfaces so that the light source 16 can be attached to a selected one of any of those locations and provide illumination to the selected location.

An attachment feature other than permanent magnets can be provided to the light source 16 whereby the light source is both removably attachable at the base station 40 and removably attachable at an interior surface of the freezer chest 10 away from the base station at a selected one of a plurality of locations within the freezer chest interior 12. For example, a hook and loop fastening arrangement can be employed. In that case, strips of loop material can be secured within the recess 42 and at advantageous locations at the interior surfaces of the freezer chest 10 at which the light source 16 can be expected to provide beneficial illumination to the freezer chest interior 12 and a strip of hooked material secured to the light source 16. As another example, clamping brackets of a size that can clamp onto and secure the light source 16 in place can be installed within the recess 42 and at advantageous locations at the interior surfaces of the freezer chest 10 at which the light source 16 can be expected to provide beneficial illumination to the freezer chest interior 12.

In order for the light source 16 to be removed from and returned to the base station 40 and placed at selected positions throughout the interior of the freezer chest 12, the electrically conductive line 17 is of a length sufficient to permit the light source 16 to be removably attachable at the one or more enclosure interior surfaces comprising the freezer chest interior surfaces away from the base station 40 at a position enabling the light source to illuminate any selected one of the plurality of locations within the enclosure interior. In the example of the first embodiment of the invention shown in FIGS. 1 and 2, an electric cord reel 46 is provided at the recess 42 of the base station 40 to hold the electrically conductive line 17 in a completely reeled condition when the light source 16 is maintained at the base station 40 and to allow the electrically conductive line 17 to unreel to the required extent when the light source is moved from the base station 40 to a selected one of a plurality of locations within the freezer chest interior 12.

In the example of the second embodiment of the invention illustrated in FIGS. 3 and 4, the electrically conductive line that is electrically configured to be connected at the enclosure to the source of electrical power and connected to the light source 16 is encased within a flexible self-supporting electrical conduit 50. The freezer chest 10 of the example of the second embodiment includes a base station 40 at which the light source 16 can be maintained. Specifically, the base station 40 includes a recess 42 at the lid interior surface 27 of the hinged lid 13 within which the light source 16 is removably maintained. An annular supporting bracket 52 is mounted to the lid interior surface 27 surrounding the recess 42. A groove 54 is provided around the perimeter of the annular supporting bracket 52 and the flexible self-supporting electrical conduit 50 can be maintained at the base station 40 by wrapping the flexible self-supporting electrical conduit 50 around the annular supporting bracket 52 within the groove 54 as is illustrated in FIG. 3. The flexible self-supporting electrical conduit 50 is sufficiently flexible that it can be readily wound and unwound from the annular supporting bracket 52. The electrically conductive line is not visible in FIGS. 3 and 4 because it is encased within the flexible self-supporting electrical conduit 50.

The flexible self-supporting electrical conduit 50 and the encased electrically conductive line are of a length sufficient to permit the position of the light source 16 to be adjusted, when the flexible self-supporting electrical conduit 50 is displaced from the annular supporting bracket 52 at the base station 40. Correlatively, the flexible self-supporting electrical conduit 50 is sufficiently flexible to allow for the adjustment of the light source 16 so as to illuminate any selected one of the plurality of locations within the enclosure interior comprising the freezer chest interior 12 as illustrated in FIG. 4. In this connection, the flexible self-supporting electrical conduit 50 can be constructed in a manner similar to the manner in which gooseneck support aims are constructed so that the flexible self-supporting electrical conduit 50 can be freely manipulated to place the light source 16 in a desired position.

In an example of a third embodiment of the invention illustrated in FIG. 5, the enclosure of the assembly comprises the freezer chest 10 that includes the hinged lid 13 and the storage compartment 14 within which the enclosure interior comprising the freezer chest interior 12 is located. The hinged lid 13 is supported for pivotal movement at the upper edge 15 of the storage compartment 14 and allows for access to be had to the enclosure interior upon raising of the hinged lid 13 from the upper edge 15 of the storage compartment 14. The light source 16 is electrically connected to the electrically conductive line 17 and includes an attachment feature by means of which the light source is removably attachable at positions enabling the light source 16 to illuminate any selected one of the plurality of locations within the enclosure interior, as shown in FIG. 5 in which the light source 16 is shown as attached to the second side wall interior surface 26. As described above in connection with the example of the first embodiment shown in FIGS. 1 and 2, the attachment feature can comprise for example a magnetic material, a hook and loop arrangement and a clamping arrangement. The electrically conductive line 17 is of a length sufficient to permit the light source 16 to be removably attached to each position enabling the light source 16 to illuminate any selected one of the plurality of locations within the enclosure interior comprising the freezer chest interior 12, and the electrically conductive line 17 is releasably stored at the upper edge 15 of the storage compartment 14, As can be seen in FIG. 5, the electrically conductive line 17 is held at the upper edge 15 of the storage compartment by a series of J-shaped brackets 60.

As indicated above, the present invention has application in connection with enclosures in general and is not limited to being applied at freezer chests. For example, the invention also relates to other types of refrigeration appliances such as refrigeration appliances at which the appliance interior is maintained at temperatures sufficiently tow enough to preserve perishable articles but not so low as to freeze the articles. In addition, the invention applies to enclosures that do not perform a refrigerating function but simply perform a storage function such a storage boxes, closets and cupboards for example. Also, the light source can comprise, for example, an incandescent light source, a fluorescent light source and a light-emitting diode light source.

The invention has been described above using specific examples; however, it will be understood by those having ordinary skill in the art that various alternatives may be used and equivalents may be substituted for elements or steps described herein without deviating from the scope of the invention. Modifications may be necessary to adapt the invention to a particular situation or to particular needs without departing from the scope of the invention. It is intended that the invention not be limited to the particular implementations described herein, but that the claims be given their broadest interpretation to cover all embodiments, literal or equivalent, covered thereby.

What is claimed is:

1. An assembly comprising:

an enclosure including an enclosure interior configured to retain articles therein;

an electrically conductive means by which the enclosure can be electrically connected to a source of electrical power for providing electrical energy to the enclosure for application to an operation that relies on electric energy for its performance and takes place at the enclosure interior;

a light source, the position of which is adjustable so as to illuminate any selected one of a plurality of locations within the enclosure interior; and an electrically conductive line electrically configured to be connected at the enclosure to the source of electrical power and connected to the light source for providing electrical energy to the light source, wherein:

the enclosure interior is delimited by one or more enclosure interior surfaces, the light source is removably located at one of the one or more enclosure interior surfaces at a base station for the light source, the light source including an attachment feature whereby the light source is both removably attachable at the one of the one or more enclosure interior surfaces at the base station and removably attachable at the one or more enclosure interior surfaces away from the base station at positions enabling the light source to illuminate any selected one of the plurality of locations within the enclosure interior, and the electrically conductive line is of a length sufficient to permit the light source to be removably attachable at the one or more enclosure interior surfaces away from the base station at positions enabling the light source to illuminate any selected one of the plurality of locations within the enclosure interior.

2. The assembly of claim 1, wherein the enclosure comprises a refrigeration appliance.

3. The assembly of claim 2, wherein the refrigeration appliance comprises a freezer chest, the enclosure interior comprises a freezer chest interior and the operation that takes place at the enclosure interior takes place at the freezer chest interior and comprises the maintenance of perishable articles at the freezer chest interior at temperatures at and below 32 degrees Fahrenheit.

4. The assembly of claim 1, wherein the enclosure includes a hinged lid that includes a lid interior surface that comprises one of the enclosure interior surfaces, the hinged lid allowing for access to be had to the enclosure interior upon raising of the hinged lid from a position closing off the enclosure interior, and the base station includes a recess at the lid interior surface within which the light source can be removably maintained.

5. The assembly of claim 4, including an electric cord reel that holds the electrically conductive line.

6. The assembly of claim 5, wherein the attachment feature comprises a magnetic material, and each position enabling the light source to illuminate any selected one of the plurality of locations within the enclosure interior and the recess include a material that is magnetically attractive, whereby the light source can be attached at a selected one of each position and the recess by means of the magnetic material.

7. The assembly of claim 4, wherein the enclosure comprises a refrigeration appliance.

8. The assembly of claim 7, wherein the refrigeration appliance comprises a freezer chest, the enclosure interior comprises a freezer chest interior and the operation that takes place at the enclosure interior takes place at the freezer chest interior and comprises the maintenance of perishable articles at the freezer chest interior at temperatures at and below 32 degrees Fahrenheit.

9. The assembly of claim 8, including an electric cord reel that holds the electrically conductive line.

10. The assembly of claim 9, wherein the attachment feature comprises a magnetic material and each position enabling the light source to illuminate any selected one of the plurality of locations within the freezer chest interior includes a material that is magnetically attractive, whereby the light source can be attached at a selected one of each position by means of the magnetic material.

11. The assembly of claim 1, wherein the electrically conductive line is encased within a flexible self-supporting electrical conduit.

12. The assembly of claim 11, wherein the enclosure comprises a refrigeration appliance.

13. The assembly of claim 12, wherein the refrigeration appliance comprises a freezer chest, the enclosure interior comprises a freezer chest interior and the operation that takes place at the enclosure interior takes place at the freezer chest interior and comprises the maintenance of perishable articles at the freezer chest interior at temperatures at and below 32 degrees Fahrenheit.

14. The assembly of claim 13, wherein the freezer chest includes the base station at which the light source and the flexible self-supporting electrical conduit can be maintained, and the electrically conductive line and the flexible self-supporting electrical conduit are of a length sufficient to permit the position of the light source to be adjusted so as to illuminate any selected one of the plurality of locations within the freezer chest interior.

15. The assembly of claim 14, wherein the freezer chest includes a hinged lid that includes a lid interior surface, the hinged lid allowing for access to be had to the freezer chest interior upon raising of the hinged lid from a position closing off the freezer chest interior, and the base station includes a recess at the lid interior surface within which the light source is removably maintained.

16. The assembly of claim 1, wherein the enclosure includes a hinged lid and a storage compartment within which the enclosure interior is located, the hinged lid being supported for pivotal movement at an upper edge of the storage compartment and allowing for access to be had to the enclosure interior upon raising of the hinged lid from the upper edge of the storage compartment, and the electrically conductive line is releasably stored at the upper edge of the storage compartment.

17. The assembly of claim 16, wherein the enclosure comprises a refrigeration appliance.

18. The assembly of claim 17, wherein the refrigeration appliance comprises a freezer chest, the enclosure interior comprises a freezer chest interior and the operation that takes place at the enclosure interior takes place at the freezer chest interior and comprises the maintenance of perishable articles at the freezer chest interior at temperatures at and below 32 degrees Fahrenheit.

19. The assembly of claim 18, wherein the attachment feature comprises a magnetic material and each position enabling the light source to illuminate any selected one of the plurality of locations within the freezer chest interior includes a material that is magnetically attractive, whereby the light source can be attached at a selected one of each position by means of the magnetic material.

* * * * *